US007513277B2

(12) United States Patent
Crook et al.

(10) Patent No.: US 7,513,277 B2
(45) Date of Patent: Apr. 7, 2009

(54) LOW TENSILE CREEP BELT

(75) Inventors: Robert Crook, Wilson, NC (US); Sanjay Patel, Summerville, SC (US); Heping Zhang, Summerville, SC (US); Craig Valentine, Summerville, SC (US); Hubert Walkenhaus, Kerpen (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 11/752,541

(22) Filed: May 23, 2007

(65) Prior Publication Data

US 2008/0289716 A1 Nov. 27, 2008

(51) Int. Cl.

| | |
|---|---|
| ***D21F 7/10*** | (2006.01) |
| ***D03D 7/00*** | (2006.01) |
| ***D03D 3/04*** | (2006.01) |
| *D03D 25/00* | (2006.01) |

(52) U.S. Cl. ..... 139/383 AA; 139/383 A; 139/383 R

(58) Field of Classification Search ..... 139/383 A, 139/383 AA; 162/348, 358.1, 358.2, 358.3, 162/358.4, 900, 901, 902, 904
See application file for complete search history.

(56) References Cited

U.S. PATENT DOCUMENTS

| | | | | | |
|---|---|---|---|---|---|
| 660,027 | A | * | 10/1900 | Proctor | 198/847 |
| 1,638,721 | A | * | 8/1927 | Asten | 28/141 |
| 2,158,007 | A | * | 5/1939 | Ellis et al. | 24/33 C |
| 2,435,467 | A | * | 2/1948 | Spencer | 428/61 |
| 2,748,445 | A | * | 6/1956 | Skeer et al. | 428/58 |
| 2,821,771 | A | * | 2/1958 | Skeer | 28/142 |
| 3,075,274 | A | * | 1/1963 | Mizell | 28/142 |
| 3,086,276 | A | * | 4/1963 | Bartz et al. | 428/109 |
| 3,094,763 | A | * | 6/1963 | Mizell et al. | 442/152 |
| 3,109,219 | A | * | 11/1963 | Flynn et al. | 162/348 |
| 3,110,078 | A | * | 11/1963 | Birger | 34/95 |
| 3,214,327 | A | * | 10/1965 | Wicker et al. | 162/205 |
| 3,657,068 | A | * | 4/1972 | Ivanowicz | 162/358.2 |
| 3,735,451 | A | * | 5/1973 | Haythornthwaite | 24/33 C |
| 3,815,645 | A | * | 6/1974 | Codorniu | 139/383 AA |
| 3,885,596 | A | * | 5/1975 | Alexeff | 139/28 |
| 3,885,603 | A | * | 5/1975 | Slaughter | 139/425 A |
| 4,171,009 | A | * | 10/1979 | Karm | 139/425 A |
| 4,174,739 | A | * | 11/1979 | Rasero et al. | 139/388 |
| 4,311,172 | A | * | 1/1982 | Eckstein | 139/383 AA |
| 4,364,421 | A | * | 12/1982 | Martin | 139/383 AA |
| 4,574,435 | A | * | 3/1986 | Luciano et al. | 24/33 C |
| 4,791,708 | A | * | 12/1988 | Smolens | 24/33 C |
| 4,806,208 | A | * | 2/1989 | Penven | 162/199 |
| 4,824,525 | A | * | 4/1989 | Penven | 162/358.2 |
| 4,846,231 | A | * | 7/1989 | Penven | 139/383 AA |
| 4,883,096 | A | * | 11/1989 | Penven | 139/383 A |
| 4,892,781 | A | * | 1/1990 | Penven | 442/189 |
| 4,896,702 | A | * | 1/1990 | Crook | 139/383 A |
| 4,940,630 | A | * | 7/1990 | Penven | 442/189 |
| 4,976,293 | A | * | 12/1990 | Aldrich | 139/383 AA |
| 4,991,630 | A | * | 2/1991 | Penven | 139/383 A |

(Continued)

*Primary Examiner*—Bobby H Muromoto, Jr.
(74) *Attorney, Agent, or Firm*—Taylor & Aust, P.C.

(57) ABSTRACT

An endless fabric belt subjected to a substantial running tension. The belt has an endless woven fabric formed from a plurality of MD (machine direction) ultra high molecular weight polymer strands approaching zero creep at high tensile loads. A plurality of CMD (cross machine direction) strands are interwoven with the MD strands. The plurality of MD strands have first and second ends spliced to one another to form an endless belt, the splices forming a significant linear MD overlap of about 30 cm with each other.

20 Claims, 2 Drawing Sheets

U.S. PATENT DOCUMENTS 5,048,675 A * 9/1991 Nadalutti ..... 198/844.2
5,053,109 A * 10/1991 Penven ..... 162/348
5,169,570 A * 12/1992 Sayers et al. ..... 264/496
5,211,799 A * 5/1993 Madrzak ..... 156/518
5,740,982 A * 4/1998 Kaufmann ..... 242/555.3
5,746,257 A * 5/1998 Fry ..... 139/383 AA
5,787,936 A * 8/1998 Snipes ..... 139/383 AA
5,820,959 A * 10/1998 Whittaker ..... 428/61
6,436,240 B1 * 8/2002 Jeffrey ..... 162/358.2
6,896,124 B2 * 5/2005 Herold ..... 198/844.2
7,005,041 B2 * 2/2006 Best ..... 162/358.2
7,025,095 B2 * 4/2006 Zils ..... 139/383 AA
7,105,465 B2 * 9/2006 Patel et al. ..... 442/88
2005/0016915 A1 * 1/2005 Beck ..... 210/490
2005/0103224 A1 * 5/2005 Patel ..... 106/2
2005/0199361 A1 * 9/2005 Danzler ..... 162/358.2
2006/0076449 A1 * 4/2006 Stitz et al. ..... 242/525
2006/0137840 A1 * 6/2006 Burazin et al. ..... 162/109
2007/0060001 A1 * 3/2007 Patel et al. ..... 442/76
2007/0155269 A1 * 7/2007 Patel et al. ..... 442/149

* cited by examiner

LOW TENSILE CREEP BELT

BACKGROUND OF THE INVENTION

1. Field of the Invention

The present invention relates to belts, and, more particularly, to belts used in the paper machinery field.

2. Description of the Related Art

It has been found in the paper machinery art that it is possible to create a "press nip" by wrapping fabrics around a roll at high contact angles with a wet paper sheet between the fabrics. By applying high tensile load to the outer fabric, compressive forces are transmitted to the sheet and force water into the inner fabric. The advantage of this method verses a normal roll press is that the pressing zone and dwell time can be very large and the compressive force on the paper relatively low so that sheet bulk is not minimized by undue compression.

The outer fabric in this arrangement, in addition to experiencing high tensile loads, must have sufficiently high permeability on the range of 100 to 600 CFM (cubic feet/min) to permit air passage through the fabric to help dry the sheet, and in some cases permit evaporation of water from the sheet.

While this approach is effective in drying the paper, the tensile demand on the outer fabric is extremely high. The running tension is in the range of 15 to 80 kN/m. These loads are far higher than those for normal textile fabrics which may cause the outer fabric to stretch and narrow excessively and any joints or seams to fail prematurely. One approach to eliminate this problem has been to incorporate steel belts which withstand the tension. However, they are too heavy and can be dangerous if they fail in operation. In addition to that, they may not have sufficient permeability to achieve the proper drying function of the paper.

Therefore a need exists for a fabric in such an environment that can operate under consistently high tension without significant change in dimensions (creep) and also without joints and/or connections that can cause failure.

SUMMARY OF THE INVENTION

The invention, in one form, is directed to an endless fabric belt subjected to a substantial running tension. The belt has one of a flat or endless woven fabric formed from at least one MD (machine direction) strand approaching zero creep at high tensile loads. An at least one CMD (cross machine direction) strand is interwoven with the MD strand. The MD strand has first and second ends spliced to one another to form an endless belt, the splice forming a significant linear MD overlap with each other.

The invention, in another form, is directed to a method of forming an endless fabric belt subjected to a substantial running tension. The method includes the steps of interweaving an at least one MD (machine direction) strand with at least one CMD (cross machine direction) strand to form a fabric. At least the MD strand is formed from material approaching zero creep at high tensile loads and has first and second ends. The first and second ends of the MD strand are spliced to one another with a significant linear MD overlap to form an endless belt.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one embodiment of the invention and such exemplification is not to be construed as limiting the scope of the invention in any manner.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

Figure 1:
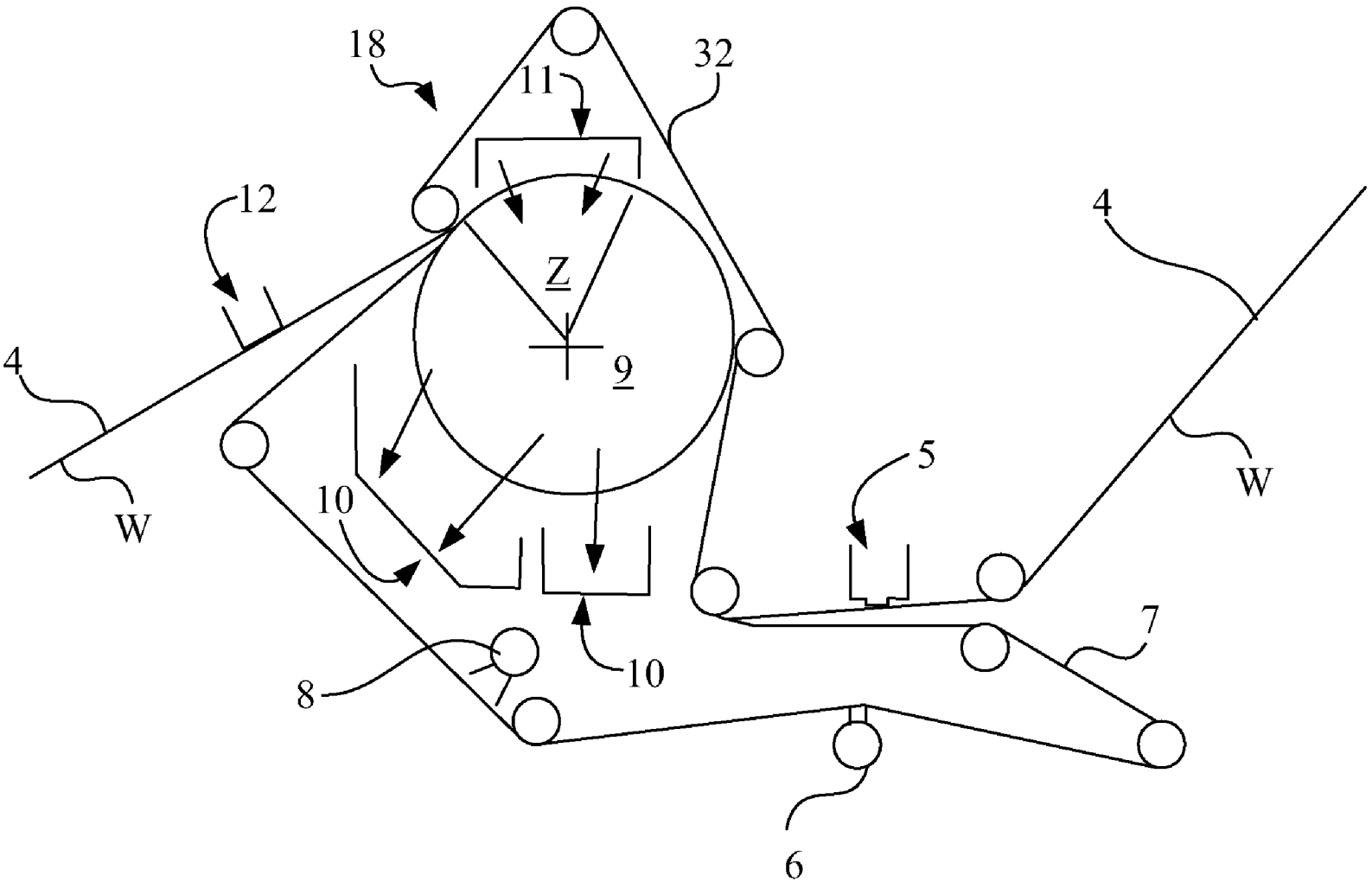
FIG. 1 shows a schematic view of a paper machine process in which the present invention is utilized.

Referring now to the drawings, FIG. 1 shows a diagram of a dewatering system that utilizes a main pressure field in the form of a belt press generally indicated by reference character 18. A web W of fiber material is carried by a structured fabric 4 to a vacuum box 5 that is required to achieve a solids level of between approximately 15% and approximately 25% on a nominal 20 grams per square meter (gsm) web-running at between approximately −0.2 and approximately −0.8 bar vacuum, and can preferred operate at a level of between approximately −0.4 and approximately −0.6 bar. A vacuum roll 9 is operated at a vacuum level of between approximately −0.2 and approximately −0.8 bar. Preferably, it is operated at a level of approximately −0.4 bar or higher. The belt press 18 includes a single fabric run 32 capable of applying pressure to the non-sheet contacting side of the structured fabric 4 that carries the web W around the suction roll 9. The fabric 32 is a continuous or endless circulating belt guided around a plurality of guide rolls and is characterized by being permeable. An optional hot air hood 11 is arranged within the belt 32 and is positioned over the vacuum roll 9 in order to improve dewatering. The vacuum roll 9 includes at least one vacuum zone Z and has a circumferential length of between approximately 200 mm and approximately 2500 mm, preferably between approximately 800 mm and approximately 1800 mm, and more preferably between approximately 1200 mm and approximately 1600 mm. The thickness of the vacuum roll shell can preferably be in the range of between approximately 25 mm and approximately 75 mm. The mean airflow through the web 112 in the area of the suction zone Z can be approximately 150 $m^3$/min per meter machine width. The solid level leaving the suction roll 9 is between approximately 25% and approximately 55% depending on the installed options, and is preferably greater than approximately 30%, is more preferably greater than approximately 35%, and is even more preferably greater than approximately 40%. An optional pick up vacuum box 12 can be used to make sure that the sheet or web W follows the structured fabric 4 and separates from a dewatering fabric 7. It should be noted that the direction of air flow in a first pressure field (i.e., vacuum box 5) and the main pressure field (i.e., formed by vacuum roll 9)

are opposite to each other. The system may also utilize one or more shower units 8 and one or more Uhle boxes 6.

There is a significant increase in dryness with the belt press 18. The belt 32 should be capable of sustaining an increase in belt tension of up to approximately 80 KN/m without being destroyed and without destroying web quality. There is roughly about a 2% more dryness in the web W for each tension increase of 20 KN/m. Conventional synthetic belts may not achieve a desired tensile force of less than approximately 45 KN/m and the belt may stretch too much during running on the machine.

Figure 2:
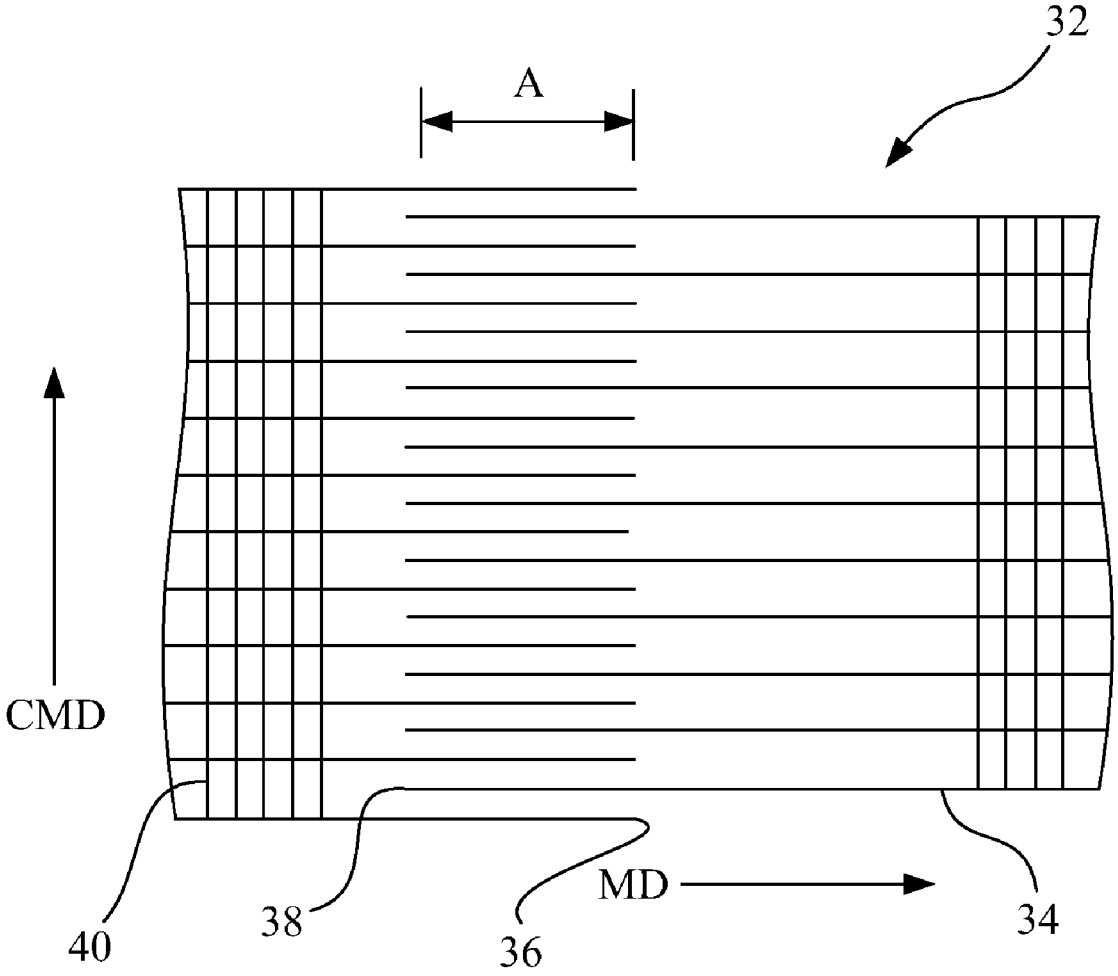
FIG. 2 is a plan view of an endless belt embodying the present invention.

In accordance with the present invention, the belt illustrated in FIG. 2 is provided. The belt 32 has at least one machine direction (MD) strand 34 that extends beyond the extent of FIG. 2 to form an endless loop terminating in ends 36 and 38. The strand 34 has a significant overlap defined by the reference character A. Interwoven with the MD yarn 34 is at least one cross machine direction (CMD) yarn 40. At least the MD yarn 34 is formed from endless woven fabric approaching zero creep, or elongation, at high tensile loads, preferably ultra high molecular weight polymers. Such polymers are also known as high modulus polymers. These polymers have extremely long chains, with molecular weight numbering in the millions, usually between 2 and 6 million. The longer chain serves to transfer load more effectively to the polymer backbone by strengthening intermolecular interactions. Examples of the MD strands are selected from the group consisting of SYNSTRAND polyester, TENSYLON (made from ultra-high molecular weigh polyethylene), UHMWPE (ultra high molecular weigh polyethylene), and KEVLAR® (aramid fibers). The CMD strands 40 may also be formed from these materials but in any event the MD strands 34 are to be formed from the ultra high molecular weight materials since the longitudinal tension of the endless fabric belt ultimately formed is greater than 25 kilo Newton meters to 50 kilo Newton meters and preferably between 25 kilo Newton meters to 40 kilo Newton meters. The overlap A for the MD strands 34 is about 30 cm. The endless fabric belt 32 is woven from at least one layer of MD and CMD strands. The fabric 32 may be formed from multiple layers. Furthermore the strands 34 and 40 may be heat set to reinforce the junctions between the MD and CMD strands. Preferably the endless belt 32 has a contact point to the contact area of the sheet of at least 400 contact points per 10 $cm^2$ and preferably about 4500 contact points per 10 $cm^2$.

The MD yarn 34 may be looped to form the endless belt 32 by being interwoven with CMD yarn 40. Alternatively a plurality of MD yarns 34 may be interwoven with a plurality of CMD yarns 40 to form a flat woven belt joined at the ends of MD yarns 34 to form an endless belt.

The MD yarns 34 may be combined with standard polymer yarns to control cost of the belt or they may be twisted or spliced into a composite yarn.

The resultant structure enables operation of a press fabric that is able to withstand the ultra high tensile loads up to 50 kilo Newton per meter and approach zero or creep. Furthermore, the yarns provide adequate porosity at least above 100 cfm to enable efficient drying of the fabric so pressed between the outer fabric 32 and the inner fabric 7.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An endless fabric belt subjected to substantial running tension, said belt comprising:

a flat woven fabric formed from a plurality of machine direction strands each approaching zero creep, at high tensile loads;

a plurality of cross machine direction strands interwoven with said plurality of machine direction strands;

each said machine direction strand having first and second ends spliced to one another to form an endless belt, said splices forming a significant linear machine direction overlap with each other, said endless belt being formed from said plurality of machine direction strands interwoven with said plurality of cross machine direction strands to form said flat woven fabric joined at the ends of said machine direction strands to form said endless belt.

2. The endless fabric belt as claimed in claim 1, wherein the endless fabric belt is structured and arranged for having a running tension which is greater than 15 kilo Newton meters to 80 kilo Newton meters.

3. The endless fabric belt as claimed in claim 1, wherein the endless fabric belt is structured and arranged for having a running tension which is at least 30 kilo Newton meters.

4. The endless fabric belt as claimed in claim 1, wherein at least said machine direction strands are formed from ultra high molecular weight polymers.

5. The endless fabric belt as claimed in claim 1, wherein at least said machine direction strands are selected from the group consisting of polyester, ultra-high molecular weight polyethylene and aramid fibers.

6. The endless fabric belt as claimed in claim 1, wherein said overlap is approximately 30 cm.

7. The endless fabric belt as claimed in claim 1, wherein said fabric is woven from at least one layer of said machine direction and cross machine direction strands.

8. The endless fabric belt as claimed in claim 7, wherein said fabric is woven and includes multiple layers.

9. The endless fabric belt as claimed in claim 1, wherein the endless fabric belt has a plurality of contact points to a contact area of a web of fiber material which is at least 400 contact points per 10 $cm^2$, the endless fabric belt being a part of a paper machine for producing a paper-based product from said web.

10. The endless fabric belt as claimed in claim 9, wherein the endless fabric belt has approximately 4500 contact points per $cm^2$.

11. The endless fabric belt as claimed in claim 1, wherein said strands are reinforced at the junctions between the machine direction and cross machine direction strands.

12. The endless fabric belt as claimed in claim 1, wherein said belt is formed by at least one elongated machine direction strand looped to form said belt.

13. A method of forming an endless fabric belt subjected to substantial running tension, said method comprising the steps of:

interweaving a plurality of machine direction strands with a plurality of cross machine direction strands to form a flat woven fabric, each said machine direction strand being formed from material approaching zero creep at high tensile loads and having first and second ends;

splicing said first and second ends of each said machine direction strand to one another with a significant linear machine direction overlap to form an endless belt, said endless belt being formed from said plurality of machine direction strands interwoven with said plurality of cross machine direction strands to form said flat woven fabric joined at the ends of said machine direction strands to form said endless belt.

14. A The method as claimed in claim 13, wherein the running tension of said belt is at least 15 kilo Newtons per meter to 80 kilo Newtons per meter.

15. A The method as claimed in claim 13, wherein said running tension is at least 50 kilo Newtons per meter.

16. The method as claimed in claim 13, wherein at least said machine direction strands are formed from ultra high molecular weight polymers.

17. The method as claimed in claim 13, wherein at least said machine direction strands are formed from the group consisting of polyester, ultra-high molecular weight polyethylene and aramid fibers.

18. The method as claimed in claim 13, wherein the linear machine direction overlap of each said machine direction strand is approximately 30 cm.

19. The method as claimed in claim 13, wherein said machine direction and cross machine direction strands are formed in at least one layer.

20. The method as claimed in claim 13, wherein said machine direction and cross machine direction strands are formed in multiple layers.

* * * * *